United States Patent [19]

Grimm

[11] Patent Number: 5,029,059

[45] Date of Patent: Jul. 2, 1991

[54] SCREEN LIGHT PROVIDED WITH BAR-SHAPED FLUORESCENT LAMP

[75] Inventor: Manfred Grimm, Arnsberg, Fed. Rep. of Germany

[73] Assignee: Firma Thorn Licht GmbH, Arnsberg, Fed. Rep. of Germany

[21] Appl. No.: 460,571

[22] Filed: Jan. 3, 1990

[30] Foreign Application Priority Data

Jan. 5, 1989 [DE] Fed. Rep. of Germany ..... 3900202

[51] Int. Cl.[5] ..... F21V 11/06

[52] U.S. Cl. ..... 362/290; 362/260; 362/342

[58] Field of Search ..... 362/290, 342, 217, 260, 362/346, 354

[56] References Cited

U.S. PATENT DOCUMENTS

| | | | |
|---|---|---|---|
| 4,428,354 | 1/1984 | Garnett | 362/342 |
| 4,539,628 | 9/1985 | Bartenbach | 362/217 |
| 4,747,027 | 5/1988 | Riegez | 362/217 |
| 4,780,800 | 10/1988 | Mullins | 362/290 |

FOREIGN PATENT DOCUMENTS

| | | | |
|---|---|---|---|
| 229967 | 11/1963 | Austria | 362/342 |
| 8106507.6 | 8/1981 | Fed. Rep. of Germany . | |
| 8531886.8 | 10/1986 | Fed. Rep. of Germany . | |
| 3643369 | 7/1988 | Fed. Rep. of Germany . | |
| 587744 | 5/1947 | United Kingdom | 362/342 |

OTHER PUBLICATIONS 0 122 972, Europäische Patentanmeldung, Ch. Bartenbach, Filed 12/20/83.

*Primary Examiner*—Ira S. Lazarus
*Assistant Examiner*—Richard R. Cole
*Attorney, Agent, or Firm*—Michael J. Striker

[57] ABSTRACT

A screen light comprises a substantially box-shaped housing having a light outlet opening, a fluorescent lamp arranged in the housing centrally in its upper region, and elements for subdividing the light outlet opening into substantially three fields including a central field and two lateral fields, so that a part of a light flux produced by the fluorescent lamp exits primarily directly in the central field, while two parts of the light flux exit from the lateral fields secondarily by reflection.

9 Claims, 2 Drawing Sheets

SCREEN LIGHT PROVIDED WITH BAR-SHAPED FLUORESCENT LAMP

BACKGROUND OF THE INVENTION

The present invention relates to a screen light provided with a bar-shaped fluorescent lamp.

Screen lights of the above mentioned general type provided with bar-shaped fluorescent lamps are known in the art. The known lamps can be further improved in the sense of a possible width, symmetricity and thereby non-glaring light distribution.

SUMMARY OF THE INVENTION

Accordingly, it is an object of the present invention to provide a screen light with a bar-shaped fluorescent lamp which has improved characteristics as to a possible width, symmetricity and therefore not-glaring light distribution from the lamp.

In keeping with these objects and with others which will become apparent hereinafter, one feature of the present invention resides, briefly stated, in a screen lamp of the above mentioned type in which the lamp has a substantially wide housing, a fluorescent lamp arranged centrally in the housing closer to its upper region, and means for distributing a light flux from the fluorescent lamp into a central field in which a light flux part exits primarily or directly, and two side fields in which light flux parts exit secondarily or by reflection.

When the screen lamp is designed in accordance with the present invention is achieves the above specified objects.

In accordance with the present invention the lamp is provided with longitudinally extending reflectors which subdivide the lamp or the light opening into the above mentioned central field with primarily exiting light, and two lateral fields with secondarily exiting light by reflection. The lateral fields can be arranged symmetrically relative to one another and have the same size.

In accordance with another feature of the present invention transverse lamellas are arranged in all fields of the lamp and provide non-glaring of the whole light flux.

Still other features are embodied in specific constructions of the reflectors. Some reflectors are formed as tip-angular V-shaped reflectors extending transversely to the cover of the housing in the lower region of the lamp. Other reflectors extend in the corner region of the lamp and are curved near the cover. The central field is formed between two first-mentioned reflectors, while each lateral field is formed between one reflector of the first type and one reflector of the second type.

The transverse lamellas can be V-shaped and include two parabolic legs. The transverse lamellas extend parallel to the cover in the central field and diagonally in the lateral fields.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
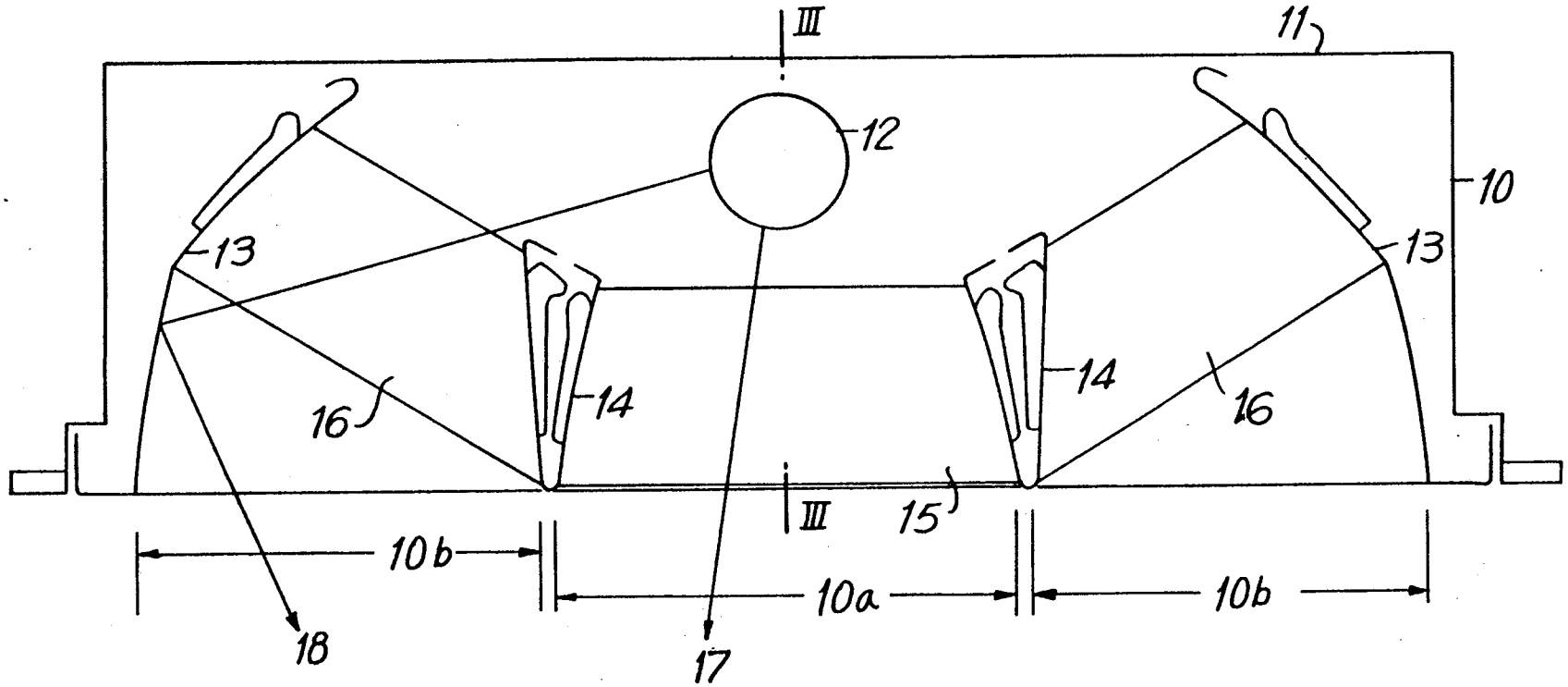
FIG. 1 is a view showing schematically a section of a screen light in accordance with the present invention.

A screen light in accordance with the present invention has a box-shaped housing of a relatively great width. The housing is limited from above by a housing cover 11. The cover 11 can have a reflecting surface.

A fluorescent lamp 12 is arranged in the housing. More particularly it is located centrally of the housing in its upper region. The total light flux is subdivided symetrically relative to the width into three substantially uniform fields, including a central field 10*a* and two lateral fields 10*b*. The light flux passes through the central field substantially primarily, or in other words directly. The secondary light flux leaves the light preferably through the lateral fields. A part of the light flux is reflected back 15 in direction toward longitudinally extending reflectors 13. The reflectors 13 are curved in a concave manner and extend through the corner regions of the housing. A part of the secondary light flux is also reflected on the housing cover.

The reflectors 13 are curved slightly and have a bend in their center. They therefore have an approximately parabola-shaped course. The central field 10 is limited at its both sides by two shaped reflectors 14 which extend over the whole longitudinal direction. Each of the reflectors 14 has a tip-angular cross-section provided with two legs. The reflectors 14 are arranged transversely to the cover in the lower region of the housing. Both inwardly directed legs of reflectors 14 have a concave parabola-shaped curvature. Both outwardly directed legs of the reflectors 14 are straight and extend vertically or approximately vertically.

Figure 2:
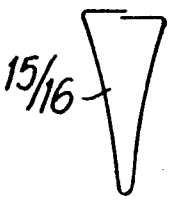
FIG. 2 is a view showing the shape of a transverse lamella of the inventive screen lamp.
Figure 3:
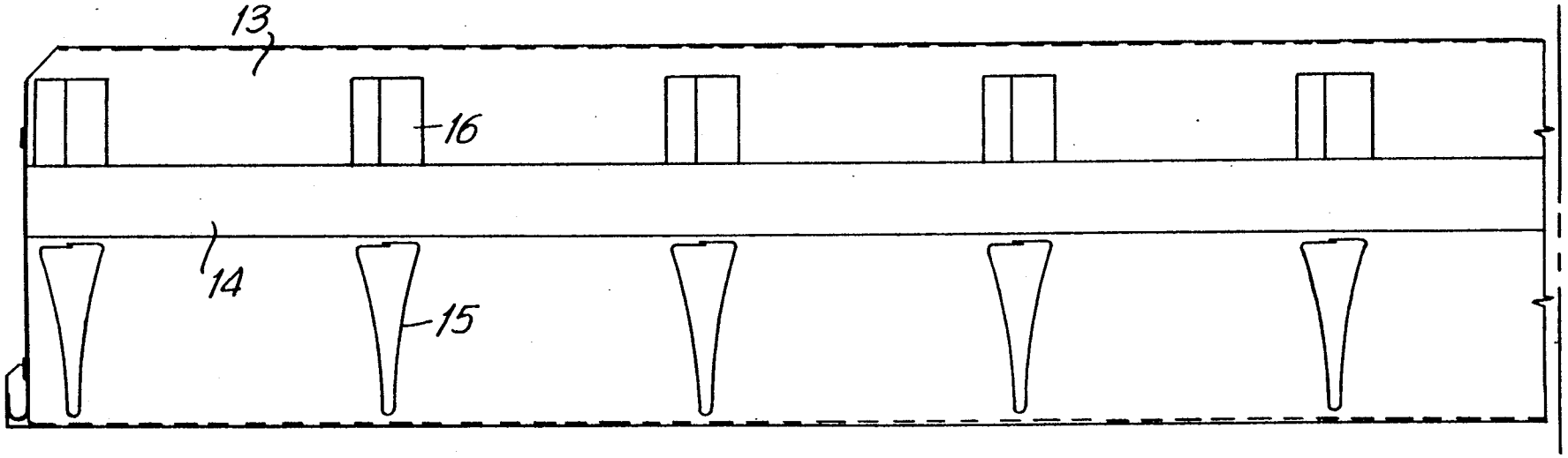
FIG. 3 is a view showing a section of the screen" light of the invention, taken along the line III—III in FIG. 1.

The central field is subdivided by a plurality of transverse lamellas 15 which extend parallel to the cover. Each of the side fields is subdivided similarly by diagonally arranged transverse lamellas 16. The transverse lamellas 16 extend from the reflectors 14 upwardly to the lateral reflectors 13. The cross-section of the transverse lamellas 15 and 16 is shown in FIG. 2. Each of the transverse lamellas 15 and 16 has two symmetrical legs with a curvature which is parabolic or parabola-like.

It will be understood that each of the elements described above, or two or more together, may also find a useful application in other types of constructions differing from the types described above.

While the invention has been illustrated and described as embodied in a screen light provided with bar-shaped fluorescent lamp, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A screen light, comprising a substantially box-shaped housing having a light outlet opening; a fluorescent lamp arranged in said housing centrally in its upper region; and means for subdividing said light outlet opening into substantially three fields including a central field and two lateral fields, so that a part of a light flux produced by said fluorescent lamp exits primarily directly in said central field, while two parts of the light flux exit from said lateral fields secondarily by reflection, said means including two shaped reflectors extending in a longitudinal direction and limiting said central field, each of said shaped reflectors having a tip-angular V-shaped cross-section.

2. A screen light as defined in claim 1, wherein said housing has a cover, said shaped reflectors extending transversely to said cover in a lower region of said housing.

3. A screen light as defined in claim 1; and further comprising two additional reflectors, each of said lateral fields being limited by one of said profiled reflectors and one of said additional reflectors.

4. A screen light as defined in claim 3, wherein each of said additional reflectors extends in a longitudinal direction.

5. A screen light as defined in claim 3, wherein said housing has a cover, each of said additional reflectors being curved and extending in a corner region of said housing close to said cover.

6. A screen light as defined in claim 1; and further comprising a plurality of transverse lamellas subdividing said fields in a transverse direction.

7. A screen light as defined in claim 6, wherein each of said lamellas is V-shaped and has two parabola-shaped legs.

8. A screen light as defined in claim 6, wherein said housing has a cover, said transverse lamellas including a first group of transverse lamellas located in said central field and extending parallel to said cover.

9. A screen light as defined in claim 6, wherein said transverse lamellas include two additional groups of transverse lamellas each located in a respective one of said side fields and extending in a diagonal direction.

* * * * *